US008332964B2

(12) United States Patent
Helwig

(10) Patent No.: US 8,332,964 B2
(45) Date of Patent: Dec. 18, 2012

(54) ELEMENT PROTECTION SYSTEM

(76) Inventor: David Helwig, St. Joseph, MO (US)

( * ) Notice: Subject to any disclaimer, the term of this patent is extended or adjusted under 35 U.S.C. 154(b) by 403 days.

(21) Appl. No.: 12/651,257

(22) Filed: Dec. 31, 2009

(65) Prior Publication Data

US 2010/0175175 A1 Jul. 15, 2010

Related U.S. Application Data

(60) Provisional application No. 61/144,786, filed on Jan. 15, 2009.

(51) Int. Cl.
*A41B 13/06* (2006.01)

(52) U.S. Cl. ..... 2/69.5; 224/153

(58) Field of Classification Search ..... 2/66, 69, 2/69.5, 93, 94, 79, 82–84, 104, 114, 275, 2/456; 224/575–577, 153
See application file for complete search history.

(56) References Cited

U.S. PATENT DOCUMENTS 4,103,377 A * 8/1978 Mayer et al. ..... 2/69.5
5,560,043 A * 10/1996 Armstrong ..... 2/69.5
6,101,631 A * 8/2000 Ferguson, Jr. ..... 2/94
6,658,666 B2 * 12/2003 Schweer ..... 2/94
7,395,555 B2 * 7/2008 Aldridge et al. ..... 2/69
2008/0209609 A1 * 9/2008 Panek ..... 2/66

* cited by examiner

*Primary Examiner* — Katherine Moran
(74) *Attorney, Agent, or Firm* — Hovey Williams LLP

(57) ABSTRACT

An element protection system for protecting wearers from cold and/or wet weather includes a garment portion having a torso section surrounding a torso-receiving cavity and a pair of sleeves, and a storage case portion including a bottom wall and a surrounding sidewall providing a main compartment sized and configured for receiving the garment portion therein. Thus, the garment portion can be stowed in the main compartment. The garment portion extends from the upper margin of the storage case portion, and a reinforcing panel extends from the upper margin over a part of a back panel of the garment portion in covering relationship to the wearers buttocks. The back panel of the garment portion includes a port sized and configured to permit passage therethrough of a strap attachable to a safety harness which can be used to restrain the torso of someone wearing the element protection system.

2 Claims, 4 Drawing Sheets

ELEMENT PROTECTION SYSTEM

This application claims the benefit of U.S. Provisional Application No. 61/144,786 filed Jan. 15, 2009, the disclosure of which is incorporated herein in its entirety.

BACKGROUND OF THE INVENTION

1. Field of the Invention

The present invention concerns a combination protective garment and storage case therefore which is integral with and functions as a part of the protective garment when worn by a user. More particularly, the element protection system hereof is most preferably provided as a full body, integrated 1 piece garment which has water repellant and scent proof properties which can be deployed from the storage case which is most preferably a backpack with shoulder straps, the garment having water repellant and scent resistant properties to provide protection from harsh weather in any stationary position.

2. Description of the Prior Art

A variety of different garments such as raincoats, parkas, ponchos and the like provide protection for the wearer from the elements. Some of these garments feature water repellant capabilities which are beneficial to those in the outdoors. Also known are garments which include self-storage capabilities, which may be stored inside a storage case or the like, including convertible garments such as those shown in U.S. Pat. Nos. 4,484,362, 4,057,854 and 6,061,831.

However, a need has developed for a winter garment that is weatherproof and scent-proof and has additional functionality as a ground blind or tree blind for use by animal observers and hunters in tree stands and that is compatible with safety/tree harnesses.

A need has also developed for a winter garment which is a one piece, full bodied insulated garment which also provides the wearer with use of his or her arms.

A further need has developed for a garment meeting the foregoing needs and which can also be easily transported and stored with an integral, unitary backpack, preferably one which has extra storage compartments accessible from the outside of the backpack and also when being worn as a protective garment.

SUMMARY OF THE INVENTION

These and other objects have largely been met by the element protection system of the present invention. That is to say, the element protection system is designed and configured not only to serve as a garment which protects the wearer from cold and/or wet weather, but also provides a combination garment and backpack which is easily transportable, permits the user to transport the garment within the backpack, protects the legs and feet of the wearer from inclement weather, functions as a blind to camouflage the appearance and scent of the wearer in the field, and facilitates the use with safety or tree straps to protect the wearer from falls.

Broadly speaking, the element protection system hereof is provided as an integrated flexible fabric member having a first garment portion including a torso covering section, a hood, and sleeves, and a second storage case portion integral with and extending from the first garment portion which also functions to receive the feet and lower portions of the legs of the wearer. The first garment portion if foldable into the second storage case portion, and a drawstring is provided to close the top of the storage case portion after the first garment portion is stowed therein. Moreover, the garment portion is uniquely compatible for use with safety harnesses used by hunters and wildlife observers in tree stands by the provision of an opening provided with a closure located on the garment in the back of the wearer. This permits the wearer to comfortably wear a safety harness while having the other benefits provided by the element protection system of the present invention.

Preferably, the second storage case portion is configured as a backpack having padded shoulder straps. The second storage case portion preferably includes flexible walls providing a main compartment for receipt of the first garment portion during storage or transport, or alternatively the feet and lower leg portion of the wearer when the user dons the garment portion. Preferably, the storage case portion has an outer layer of water repellant material such as nylon treated with a water repellant, and an inside layer made of insulating material such a polyester fiber filled liner of rip-stop nylon for durability, and coated with a moisture resistant material such as polyurethane to prevent moisture received within the second storage case from migrating into the liner or between the fabric layers. Beneficially, an overlay portion of the outer layer on the back side of the second storage case portion extends over the back side of the first garment portion, so that this overlay portion occupies the area on which the user would normally place his or her buttocks. This overlay portion not only serves as a moisture and wear-resistant seating area, but further functions as a top shield for the second storage case portion when the garment portion is stowed. Compression snaps are provided on the storage case portion to reduce the size of the system when transported or stored in the backpack mode, and to permit the main compartment to expand to full size for added space and to accommodate the feet and lower leg portion of the wearer when the garment is deployed.

The fabric of the first garment portion and the second storage case portion may be provided of a variety of materials and colors. For example, the all or a portion of garment portion and/or the storage case portion could be provided of hunter's orange for visual recognition of the user who is a hunter, or provided as a camouflage pattern which helps the system serve as a ground blind for waterfowlers or a tree blind for other hunters. Also, when intended for use at sporting events, the fabric of the first garment portion and the second storage case portion could be provided in colors selected to be compatible with those of a favorite sporting team.

These and other advantages of the element protection system of the present invention will be readily apparent to those skilled in the art after considering the drawings and description which follow, in which:

DESCRIPTION OF THE PREFERRED EMBODIMENT

Figure 1:
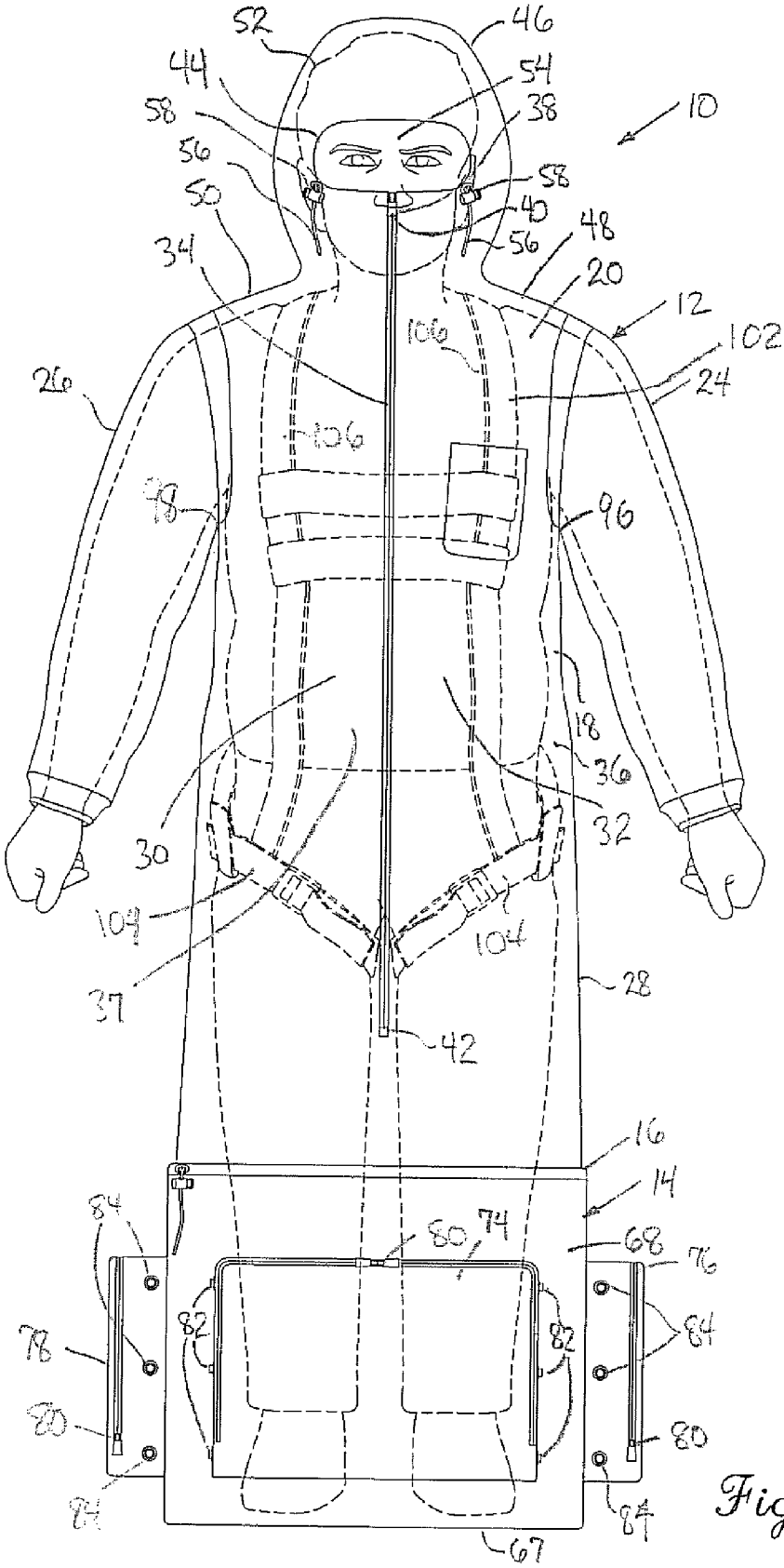
FIG. 1 is a front elevational view of the element protection system of the present invention showing the position of the garment portion and the storage case portion when the wearer is inside the system.

Referring now to the drawings, an element protection system 10 is shown in FIGS. 1 through 5 and broadly includes a first garment portion 12 and a second storage case portion 14 connected thereto. The garment portion 12 is preferably permanently connected to the storage case portion 14 by stitching, adhesive or thermal bonding, or other method of permanent attachment along an upper margin 16 of the storage case portion 14 to provide an integrated, unitary element protection system 10.

Figure 2:
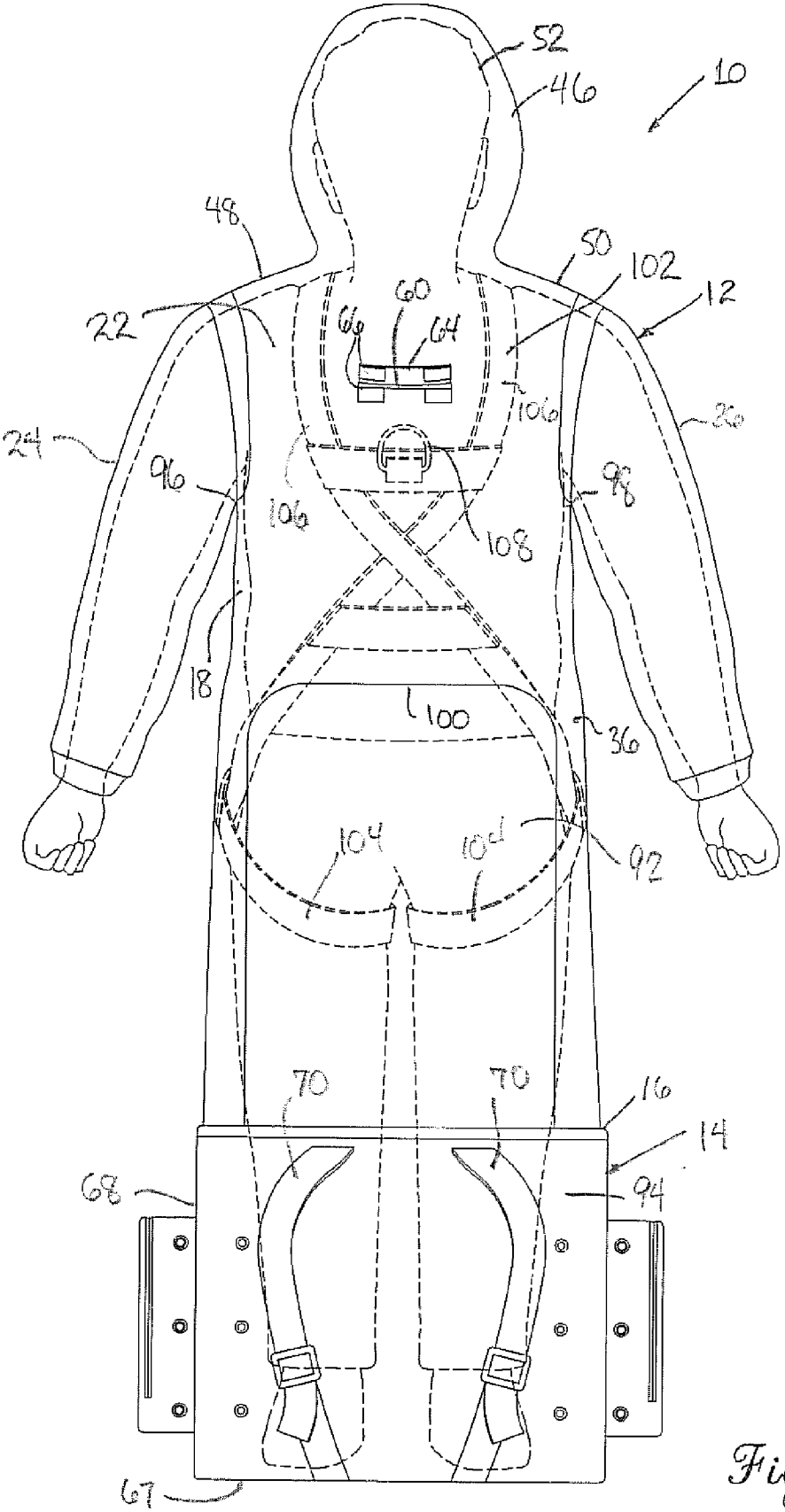
FIG. 2 is a rear elevational view of the element protection system showing an opening for permitting a safety strap to connect to a harness worn by the wearer.

In greater detail, the garment portion 12 includes a torso-covering section 18 including a front panel 20 as seen in FIG. 1, a back panel 22 as seen in FIG. 2, and first and second sleeves 24, 26. The garment portion 12 preferably has an outer layer 28 made primarily of a water-repellant material such as natural or synthetic rubber, or more preferably may be constructed of a fabric material such as nylon coated with a water repellant coating. The garment portion 12 may be lined with a insulating material such as flannel, fleece, down-filled fabric, or more preferably of a liner made of, e.g., a rip-stop nylon coated with polyurethane or other moisture-resistant material, and filled with fibrous polyester fill for insulation. The lining, for example the aforementioned liner, may be sewn or otherwise affixed to the outer layer 28 or may be removably attached to the outer layer by, for example, slide fasteners (i.e. zippers), buttons, hook and loop fabric or the like.

The front panel 20 may include left front panel 30 and right front panel 32 which are divided by an elongated seam 34. The left front panel 30 and right front panels 32 may be opened to permit ingress into a cavity 36 sized and configured to receive a human torso 37 along the seam 34 by a closure device 38, such as buttons, hook and loop fasteners or, as illustrated in FIG. 1, slide fastener 40. The seam 34, and thus the slide fastener 40 in the illustrated embodiment, extends from a lower position 42 proximate the upper margin 16 to a head-receiving opening 44. The garment portion 12 as shown in the drawings may include a hood 46 which extends upwardly from the left and right shoulder sections 48 and 50 adjacent the corresponding first and second sleeves 24, 26, such that the hood 46 receives a head 52 of the wearer and opening 44 is intended for positioning forwardly of the wearer's face 54. The opening 44 may be limited in area by a closure device such as a face drawstring 56 received in a pocket surrounding the opening 44, and the face drawstring may have cord locks 58 to aid in tightening and holding the face drawstring 56. The hood 46 as shown in the drawings is an integral and unitary component of the garment portion 12, but the hood 46 could also be detachably mounted or omitted, such that the head receiving opening would in that circumstance be located between the left and right shoulder portions 48, 50. The seam 34 thus permits the front panel 20 to be separated therealong, and the closure device 38 permits the joining of the left front panel 30 and right front panel 32 to enclose and protect the wearer.

Figure 5:
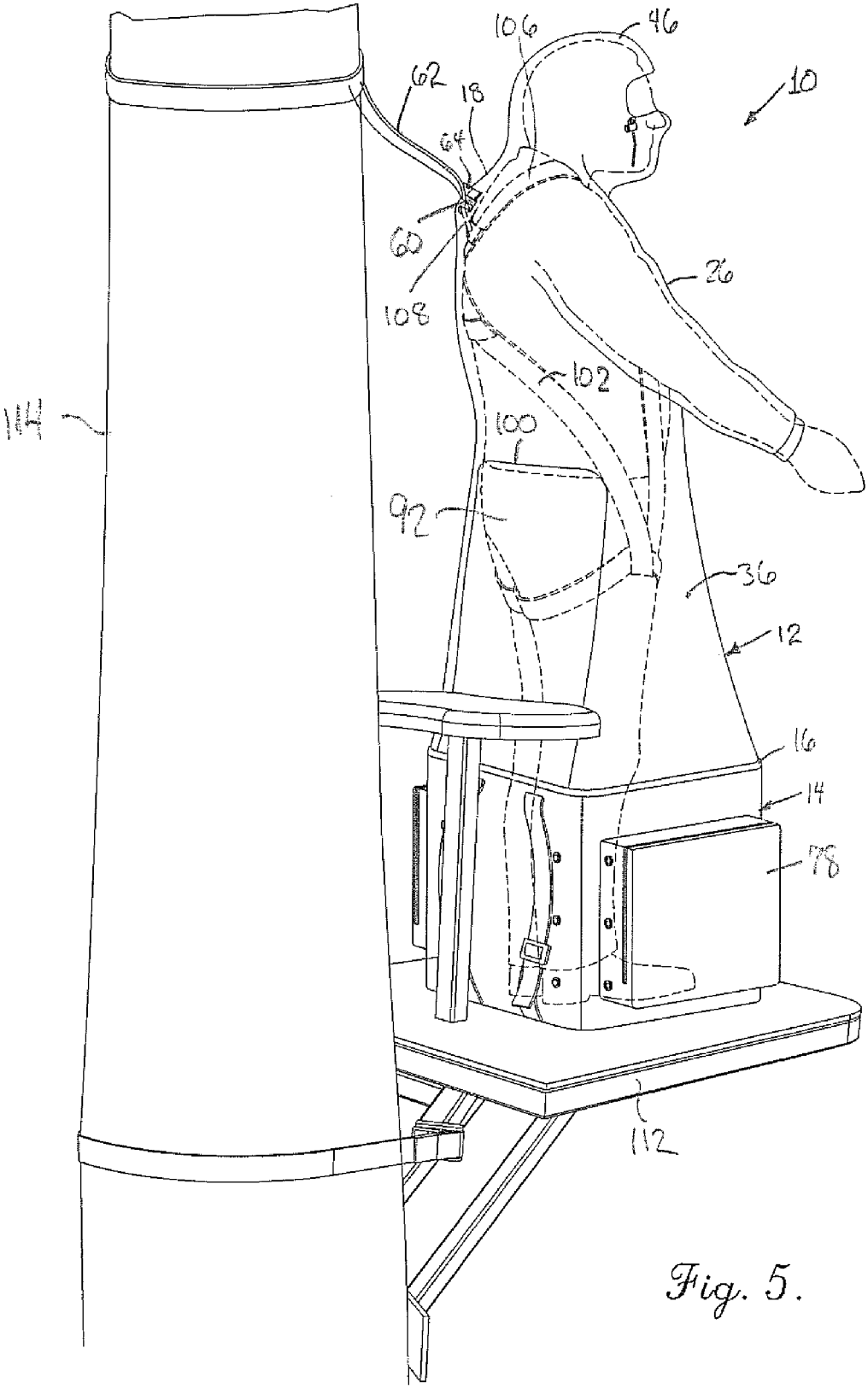
FIG. 5 is a right rear isometric view of the element protection system hereof when the garment portion is being worn and the wearer is standing on a tree stand and tethered to a tree by a harness and safety strap passing through the opening located on the back side of the garment portion.

The back panel 22 extends upwardly from the upper margin 16 of the storage case portion 14 when the wearer is in a standing position as illustrated in FIGS. 1, 2 and 5. The back panel 22 includes a slit or port 60 positioned in the back panel 22 between said first and second sleeves 24, 26. The port 60 is sized and positioned so that it is most preferably located about midway between the sleeves 24, 26 and intermediate the shoulder portions 48, 50 and the upper margin 16 of the storage case portion 14. More preferably, the port 60 is sized and oriented more proximate the shoulder portions 48, 50 for receiving a strap 62 therethrough as shown in FIG. 5. As may be seen in FIG. 2, a flap 64 which may have closures such as buttons, snaps or hook and loop closures 66 for releasably closing the flap 64 in covering relationship to the port 60, is positioned adjacent the port 60.

Figure 3:
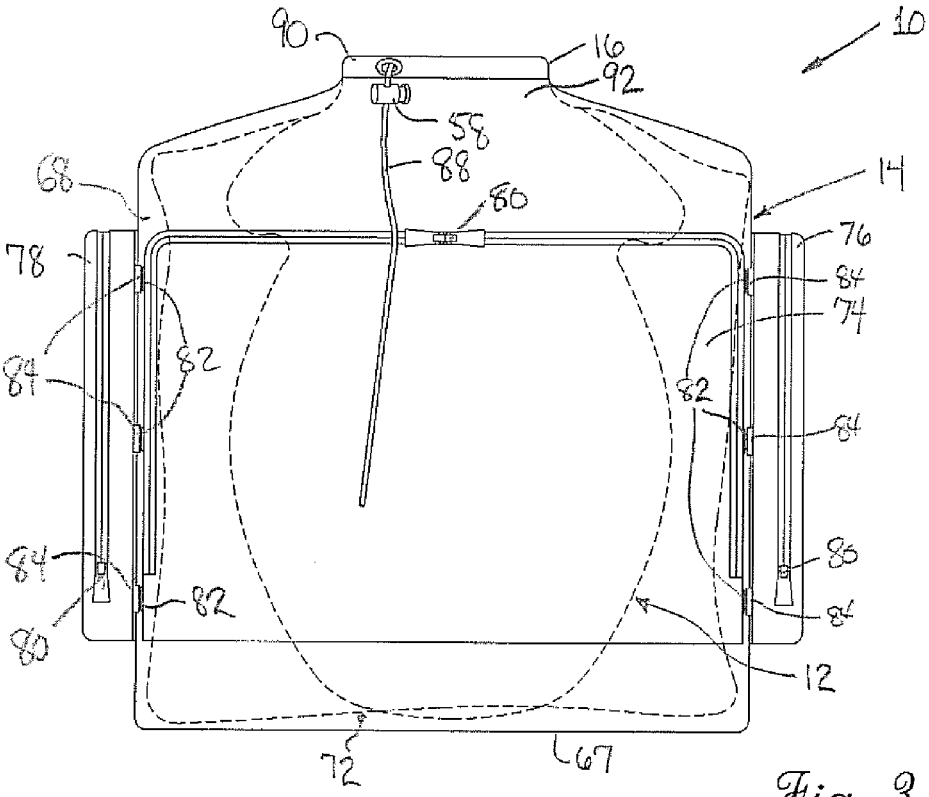
FIG. 3 is a front elevational view of the element protection system of FIGS. 1 and 2 when the garment portion is stowed within the storage case portion.
Figure 4:
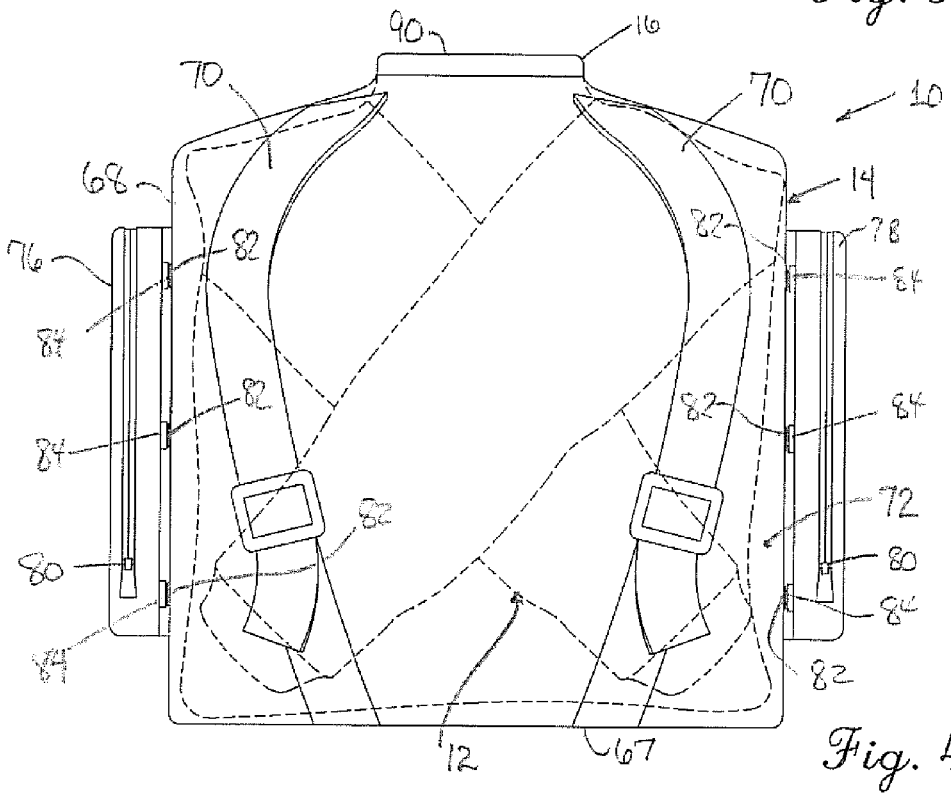
FIG. 4 is a rear elevation of view of the element protection system in the stowed condition, wherein the storage case portion is provided with shoulder straps and configured as a backpack.

The storage case portion 14 is preferably provided with an enclosed bottom 67 and has a surrounding sidewall 68 which may have an outer material 69 provided of a fabric material, the fabric material being flexible and durable such as heavy duty 600-1000 denier nylon with a waterproof or water repellant coating such as polyurethane and/or treated with other water repellant coating. Backpack straps 70 may be sewn, riveted or otherwise secured to the sidewall 68 to facilitate using the storage case portion 14 as a backpack, as illustrated in FIGS. 3 and 4. The enclosed bottom 67 and surrounding sidewall 68 define a main compartment 72 which is sized both to receive the garment portion 12 therein in a stowed condition and to also receive the feet (including when shoes or boots are worn on the feet) and at least a part of the lower leg of the wearer. A lining may be provided of insulating material inside the outer material as described above with regard to the garment portion 12. It is preferable that the lining be both insulating and waterproof or water repellant to facilitate cleaning as the boots or shoes of wearer may deposit soil therein, and the lining may be removably attached by fasteners such as snaps, buttons, hook and loop closures or the like.

Front pocket 74 and side pockets 76 and 78 may also be provided exteriorly of the main compartment 74 of the storage case portion 14 in order that desired items may be carried and stored therein. The pockets 74, 76 and 78 may be provided with closures such as slide fasteners 80 to provide access and to prevent items deposited in the pockets from escaping. As may be seen in the drawings, the pockets 74 and 76, and/or 74 and 78, may be releasably connected by closures such as snap closures having male snaps 82 and female snaps 84. When so connected, the sidewall 68 is shortened to thereby reduce the volume of the main compartment 74 and compress any contents held therein. Also, a closure 86 such as a drawstring 88 provided with a cord lock 58 may be provided in a channel which extends around the upper margin 16. The drawstring 88 may be pulled to draw the upper margin 16 inwardly as shown in FIGS. 3 and 4 to thereby provide a narrowed, smaller case opening 90 at the top of the storage case portion 16.

A reinforcing panel 92 is coupled to the storage case portion 14 and extends from the upper margin 16. The reinforcing panel 92 is preferably made of the same durable, water repellant material of the outer material 69, for example heavy duty 600-1000 denier nylon with polyurethane coating and/or treated with a water repellant. The reinforcing panel 92 is fixedly coupled, for example by thermal bonding, stitching or adhesive, to the back panel 22. The reinforcing panel 92 is of a sufficient width and length, for example extending substantially across a rear portion 94 of the sidewall 68 and of sufficient length to cover that portion of the back panel adjacent the wearers legs and buttocks. That is to say, the reinforcing panel is sized and configured to overlie at least a section of the back panel 22 intermediate the upper margin 16 and the lowermost connections 96, 98 (e.g., at the armpit area of the wearer) between the first and second sleeves 24, 26 and at least one of the front and back panels 20, 22. The reinforcing panel 92 is thus of a sufficient longitudinal length that the upper edge 100 of the reinforcing panel 92 is more proximate the lowermost connections 96, 98 than the upper margin 16.

When the garment portion 12 is stowed inside the main compartment 72 of the storage case portion 14, the reinforcing panel 92 underlies the case opening 90 and serves a second purpose of providing a reinforced, protective covering for the garment portion 12 while stowed.

The element protection system 10 may also include a safety harness 102. The safety harness 102 may include thigh loops 104 and shoulder straps 106, and have an attachment point 108 such as a ring 110 for securely attaching the strap 62.

In use, when the wearer reaches a location where the element protection system 10 will be employed, such as the tree stand 112 shown in FIG. 5, the garment portion 12 is pulled from the storage case portion 14. If the safety harness 102 is to be used, the strap 62 is passed through the port 60 and attached to a tree 114 or other anchoring device, and also to the attachment point 108. The wearer then dons the safety harness 102 as is well known.

The garment portion 12 remains connected to the storage case portion by the fastening at the upper margin 16. The wearer then opens the garment portion 12 by unfastening the slide fastener 40 extending along the seam 32 and steps into the main compartment 72. The wearer inserts his or her arms into the sleeves 20, 24, and places his or her head into the hood 46 (if used) with the wearer's face interiorly of the opening 44. The wearer can then sit down on a bench, bleacher, the ground, or the tree stand 112, with the reinforcing panel 92 positioned between the wearer's buttocks and the seat, ground or other supporting surface.

When the wearer wishes to depart, he or she opens the seam 32 by use of the slide fastener 40 and steps out of the main compartment 72. The garment portion 12 is then folded or stuffed into the main compartment portion 14, preferably with the reinforcing panel 92 positioned uppermost on the garment portion 12 as stowed in the main compartment. The drawstring 88 is then pulled to close or at least limit the size of the opening 90 along the upper margin 16. The wearer can then compress the contents of the storage case portion 14 by snapping together the snaps 82 and 84 of the snap closures. The element protection system 10 can then be conveniently carried as a backpack by positioning the backpack straps 70 over the wearer's shoulders.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. An element protection system adapted to be worn as a protective garment by a wearer comprising:

a storage case portion having a surrounding sidewall and an enclosed bottom defining therein a main compartment, the sidewall having an upper margin;

a garment portion coupled to the storage case portion along the upper margin of the sidewall, said garment portion including a front panel, a back panel opposite said front panel and defining therebetween a cavity sized and configured for receiving a human torso, and first and second sleeves sized and configured for receiving human arms attached to at least one of said front and back panels, said garment portion including a head-receiving opening positioned remote from said storage case portion and between said sleeves;

a reinforcing panel of a durable, water repellant material coupled to said storage case portion and extending from the upper margin, said reinforcing panel being sized and configured to overlie at least a section of the back panel intermediate said upper margin and the connection between said first and second sleeves and said one of said front and back panels, said reinforcing panel not overlying said front panel; and a closure member coupled to said upper margin of said storage case portion, said closure member including a drawstring, and wherein when said garment portion is received in said main compartment, said drawstring is operable to narrow an opening defined by said upper margin and said reinforcing panel is positionable within said main comparment beneath said narrowed opening and above a remainder of said garment portion;

wherein said main compartment of said storage case portion is sized and configured to receive said garment portion therein, and said sidewall of said storage case portion including first and second opposite sides each having respective side pockets provided exteriorly of the main compartment, said side pockets further including coupling members having respective mating members configured and positioned for operatively connecting one of said pockets to the other for thereby shortening the effective sidewall length to reduce the volume of said compartment and compress the garment portion when received therein.

2. An element protection system as set forth in claim 1, wherein the coupling members are snap closures and the respective mating members are opposed male and female snaps.

* * * * *